United States Patent [19]

Penner

[11] Patent Number: 4,924,682

[45] Date of Patent: May 15, 1990

[54] GOLF BAG BEVERAGE COOLER

[76] Inventor: Douglas B. Penner, 1-306 Rampton Street, Morden, Manitoba, Canada, R0G 1J0

[21] Appl. No.: 355,354

[22] Filed: May 23, 1989

[51] Int. Cl.[5] ..... F25D 3/08

[52] U.S. Cl. ..... 62/372; 62/457.5; 206/315.3

[58] Field of Search ..... 62/457.5, 372; 206/315.3, 315.5

[56] References Cited

U.S. PATENT DOCUMENTS

| | | | |
|---|---|---|---|
| 1,829,093 | 10/1931 | Hollins . | |
| 2,256,521 | 9/1941 | Kirkpatrick et al. . | |
| 2,521,573 | 9/1950 | Filler et al. | 150/1.5 |
| 4,383,563 | 5/1983 | Kirchoff | 150/1.5 R |
| 4,459,827 | 7/1984 | Rhodes | 62/457.5 |
| 4,516,409 | 5/1985 | Hobbs, Jr. et al. | 62/457.5 |
| 4,517,815 | 5/1985 | Basso | 62/457.5 |
| 4,657,135 | 4/1987 | Kjose | 206/315.3 |

*Primary Examiner*—Lloyd D. King
*Attorney, Agent, or Firm*—Jerry T. Kearns

[57] ABSTRACT

A beverage cooler for attachment to a golf bag includes an elongated base provided with a pair of straps for securement around a golf bag. A can storage tube extends between spaced parallel top and bottom portions of the base. In a first embodiment, an access opening for dispensing standard beverage cans from the tube is formed through the top base portion. A cylindrical can support disk is received for sliding movement in the tube and is biased upwardly by a coil spring received within the tube. The spring constant is predetermined to maintain the top can in a stack of standard beverage cans at a predetermined elevation. An actuating lever attached to the can support disk extends outwardly through a longitudinal slot in the tube. A pair of pivotal doors form insulated chambers on opposite sides of the base, adjacent the tube, for the reception of refreezable cooling packages. In a second embodiment, the can access opening is formed by a L-shaped pivotal door adjacent the bottom portion of the base. The door is spring biased to a closed position and is provided with an outwardly extending lever for manually dispensing the bottom can from a stack of beverage cans. In a third embodiment, the cans are dispensed through a top door hinged along a horizontal axis and in a fourth embodiment the cans are dispensed through a stop door hinged along a vertical axis. The coolers may be utilized singly or in pairs, and may be secured to or built into a golf bag.

6 Claims, 7 Drawing Sheets

GOLF BAG BEVERAGE COOLER

BACKGROUND OF THE INVENTION

1. Field of the Invention

The present invention relates to a beverage cooler for attachment to and capable of being built into a golf bag. When playing golf, especially during the hot summer months, individuals become extremely thirsty. The availability of cold beverages on most golf courses is extremely limited. In order to provide relief to such individuals, the present invention discloses a new and improved beverage cooler for storing and sequentially dispensing a stack of standard beverage cans from an insulated tube capable of utilizing refreezable cooling packages.

2. Description of the Prior Art

Various types of beverage coolers are known in the prior art. A typical example of such a golf bag beverage cooler is to be found in U.S. Pat. No. 2,521,573, which issued to I. Filler et al on Sept. 5, 1950. This patent discloses a golf bag having an integral compartment for reception of an insulated beverage container. The container is provided with a gravity type dispenser for filling a drinking cup. A zipper closed flap in the side wall of the golf bag provides access to the dispenser. U.S. Pat. No. 1,829,093, which issued to F. Hollins on Oct. 27, 1931, discloses an attachment in the form of a gravity type tube feeder for dispensing golf balls. U.S. Pat. No. 2,256,521, which issued to W. Kirkpatrick et al on Sept. 23, 1941, discloses a golf bag provided with an elongated zipper closed compartment for storing a plurality of golf balls. U.S. Pat. No. 4,383,563, which issued to C. Kirchoff on May 17, 1983, discloses a golf bag having a side wall compartment for storage of an insulated beverage container. The beverage container is mounted on a resilient clip for pivotal movement into and out of the storage compartment. U.S. Pat. No. 4,657,135, which issued to K. Kjose on April 14, 1987, discloses a combined golf bag and equipment carrier having a generally cylindrical golf bag and an elongated box-like container into which the golf bag can be fitted lengthwise at a level above the bottom of the container to provide additional storage space.

While the above mentioned devices are suited for their intended usage, none of these devices disclose a beverage cooler for storing, cooling and dispensing a stack of standard beverage cans. Additionally, none of the aforesaid beverage coolers are adapted for quick and convenient attachment to conventional golf bags. Inasmuch as the art is relatively crowded with respect to these various types of beverage coolers, it can be appreciated that there is a continuing need for and interest in improvements to such beverage coolers, and in this respect, the present invention addresses this need and interest.

SUMMARY OF THE INVENTION

In view of the foregoing disadvantages inherent in the known types of beverage coolers now present in the prior art, the present invention provides an improved golf bag beverage cooler. As such, the general purpose of the present invention, which will be described subsequently in greater detail, is to provide a new and improved golf bag beverage cooler which has all the advantages of the prior art beverage coolers and none of the disadvantages.

To attain this, representative embodiments of the concepts of the present invention are illustrated in the drawings and make use of a beverage cooler to be built into or for attachment to a golf bag which includes an elongated base provided with a pair of straps for securement around a golf bag. A can storage tube extends between spaced parallel top and bottom portions of the base. In a first embodiment, an access opening for dispensing standard beverage cans from the tube is formed through the top base portion. A cylindrical can support disk is received for sliding movement in the tube and is biased upwardly by a coil spring received within the tube. The spring constant is predetermined to maintain the top can in a stack of standard beverage cans at a predetermined elevation. An actuating lever attached to the can support disk extends outwardly through a longitudinal slot in the tube. A pair of pivotal doors form insulated chambers on opposite sides of the base, adjacent the tube, for the reception of refreezable cooling packages. In a second embodiment, the can access opening is formed by a L-shaped pivotal door adjacent the bottom portion of the base. The door is spring biased to a closed position and is provided with an outwardly extending lever for manually dispensing the bottom can from a stack of beverage cans. In a third embodiment, the cans are dispensed through a top door hinged along a horizontal axis and in a fourth embodiment the cans are dispensed through a top door hinged along a vertical axis. The coolers may be utilized singly or in pairs, and may be secured to or built into a golf bag.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf bag beverage cooler which has all the advantages of the prior art beverage coolers and none of the disadvantages.

It is another object of the present invention to provide a new and improved golf bag beverage cooler which may be easily and efficiently manufactured and marketed.

It is a further object of the present invention to provide a new and improved golf bag beverage cooler which is of a durable and reliable construction.

An even further object of the present invention is to provide a new and improved golf bag beverage cooler which is susceptible of a low cost of manufacture with regard to both materials and labor, and which accordingly is then susceptible of low prices of sale to the consuming public, thereby making such beverage coolers economically available to the buying public.

Still yet another object of the present invention is to provide a new and improved golf bag beverage cooler which provides in the apparatuses and methods of the prior art some of the advantages thereof, while simultaneously overcoming some of the disadvantages normally associated therewith.

Still another object of the present invention is to provide a new and improved golf bag beverage cooler capable of storing, cooling and dispensing a stack of standard beverage cans.

Yet another object of the present invention is to provide a new and improved golf bag beverage cooler which may be easily built into or retrofitted to conventional golf bags.

Even still another object of the present invention is to provide a new and improved golf bag beverage cooler capable of cooling a stack of standard beverage cans utilizing refreezable cooling packages.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
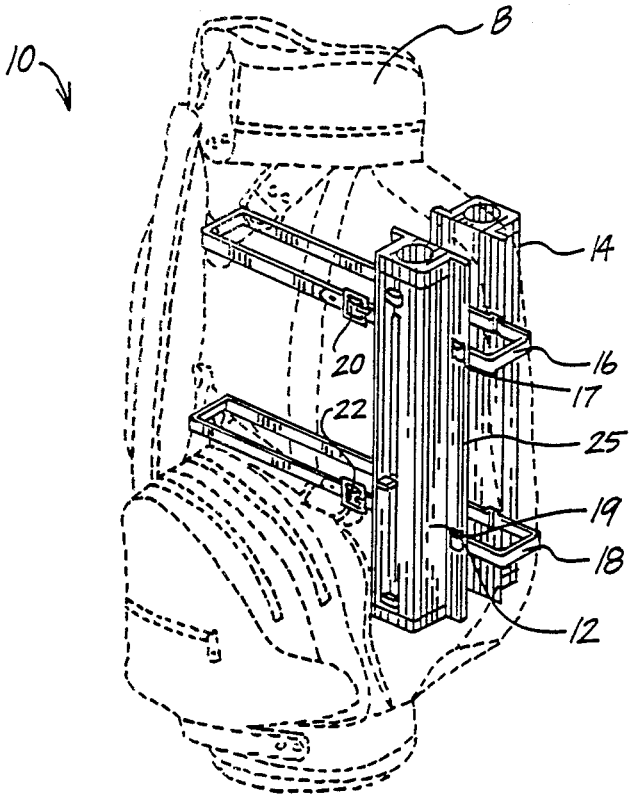
FIG. 1 is a perspective view illustrating a pair of beverage coolers according to a first embodiment of the present invention attached to a conventional golf bag.

With reference now to the drawings, and in particular to FIG. 1 thereof, a new and improved golf bag beverage cooler embodying the principles and concepts of the present invention and generally designated by the reference numeral 10 will be described.

More specifically, it will be noted that the first embodiment 10 of the invention includes a pair of beverage coolers 12 and 14. The coolers 12 and 14 are of identical construction. Each of the coolers has an elongated generally rectangular base 25 provided with pairs of aligned slots 17 and 19. A pair of straps 16 and 18 received through the slots are received around a conventional golf bag B and secured by respective buckle fasteners 20 and 22. The illustrated positioning of the coolers 12 and 14 on opposite sides of the golf bag provide a balanced weight and do not interfere with the conventional storage compartments on the bag. It is to be understood that the coolers of the present invention may be utilized either singly or in pairs, as illustrated.

Figure 2:
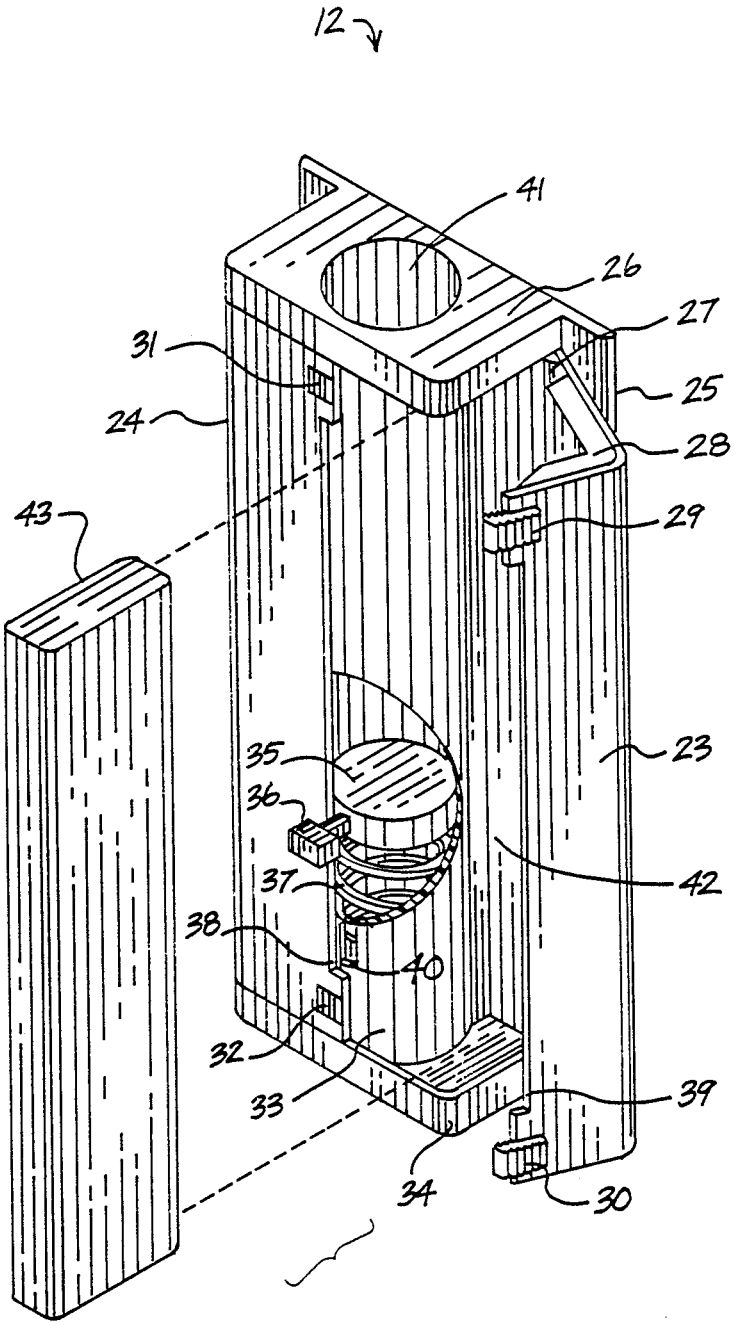
FIG. 2 is an exploded perspective view, partially cut away, illustrating the construction of the beverage cooler according to the first embodiment of the present invention.

With reference now to FIG. 2, the constructional details of the beverage cooler 12 will now be described. The elongated generally rectangular base 25 is provided with longitudinally spaced parallel top 26 and bottom 34 portions. A cylindrical beverage can storage tube 33 extends between the top 26 and bottom 34 portions. The top portion 26 has a circular access opening 41 in alignment with an open upper end of the tube 33. A longitudinal slot 40 is formed in the front portion of the tube 33. A cylindrical beverage can support disk 35 is received for longitudinal sliding movement within the tube 33. An actuating lever 36 is connected to the disk 35 and extends outwardly through the slot 40 for manually sliding the disk 35. A coil spring 37 in the tube 33 has a first end in abutment with the bottom surface of the disk 35 and a second end in abutment with the bottom base portion 34. The spring 37 has a predetermined spring constant selected for maintaining the top one of a stacked of standard beverage cans supported on the disk 35 at a constant level adjacent the access opening 41, as the cans are sequentially dispensed. A pair of L-shaped doors 23 and 24 are mounted on the base 25 by hinges 27 for pivotal movement about axes parallel to a longitudinal axis of the tube 33. Cooperating resilient plastic detent type latches 29, 31, 30 and 32 are provided on meeting edges of the doors 23 and 24 for securing the doors in a closed position around the tube 33. Each of the doors 23 and 24 is provided with a conventional foam insulation 28 and the doors form a pair of parallel insulated chambers 42 on opposite sides of the tube 33. The meeting edges of the doors 23 and 24 have cooperating notched out portions 39 and 38 which form a longitudinal slot receiving the actuating lever 36, when the doors 23 and 24 are in a closed position. A pair of elongated sealed cooling packages 43, filled with a refreezable fluid material, are removably received in the insulated chambers 42.

Figure 3:
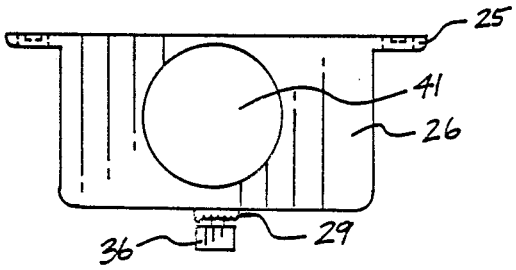
FIG. 3 is a top view of the beverage cooler according to the first embodiment of the present invention.

FIG. 3 provides a top view of the beverage cooler 12, illustrating the access opening 41.

Figure 4:
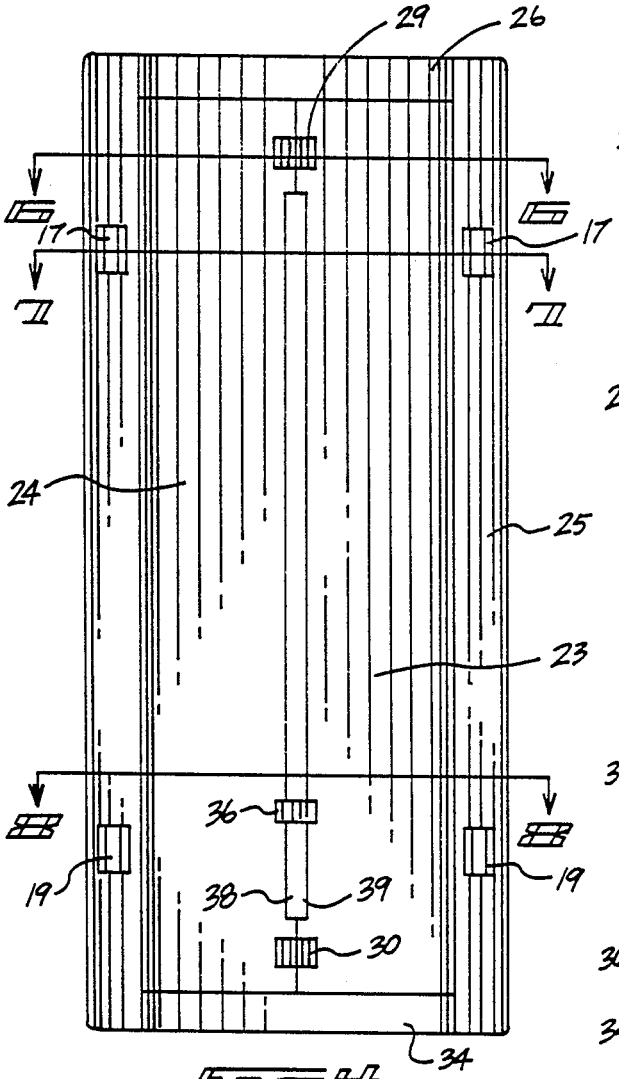
FIG. 4 is a front view of the beverage cooler according to the first embodiment of the present invention.

FIG. 4 provides a front view of the beverage cooler, which illustrates the aligned pairs of slots 17 and 19. As previously described, when the doors 23 and 24 are in the illustrated position, and latched by fasteners 29 and 30, the actuating lever 36 may be moved manually upwardly to slide the can supporting disk 35 upwardly, to dispense the top can in a stack of standard beverage cans through the top base portion 26.

Figure 5:
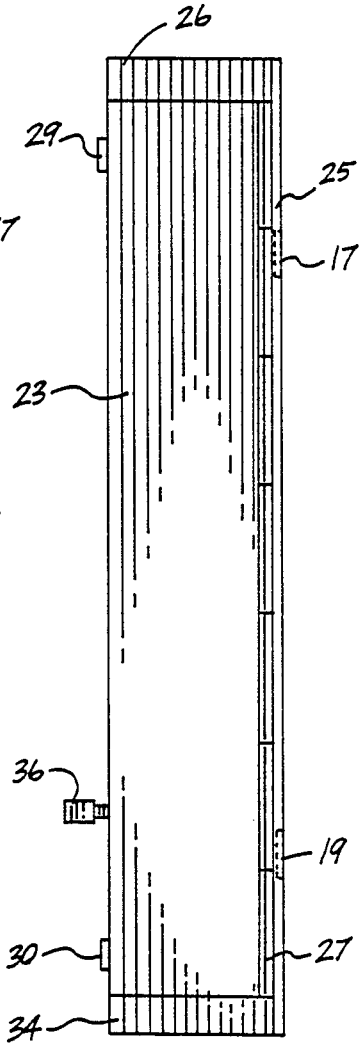
FIG. 5 is a side view of the beverage cooler according to the first embodiment of the present invention.

FIG. 5 provides a side view of the beverage cooler, which illustrates the hinge 27 which mounts the door 23 for pivotal movement to the base 25.

Figure 6:
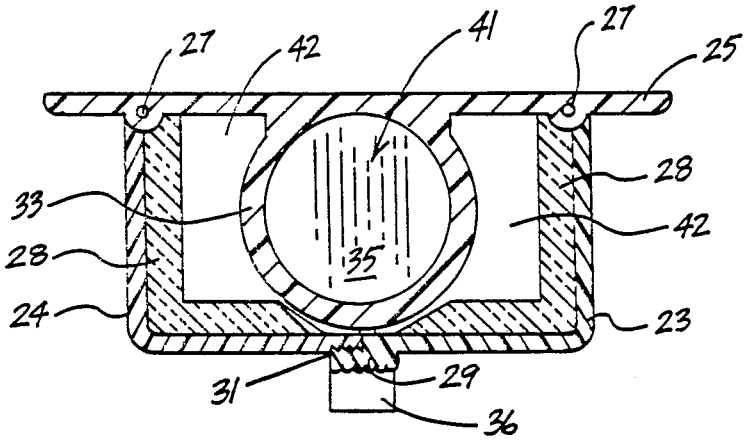
FIG. 6 is a transverse cross sectional view, taken along line 6—6 of FIG. 4.

FIG. 6 provides transverse cross sectional view, taken along line 6—6 of FIG. 4, which illustrates the cooperating resilient detent latches 29 and 31 in engagement. The can supporting disk 35 is received within the tube 33 for reciprocal longitudinal sliding movement. The chambers 42 are formed on opposite sides of the tube 33 by the insulation 28 on the doors 23 and 24. In use, the replaceable and reusable sealed packets 43 (FIG. 2) are received within the insulated chambers 42 and serve to cool a stack of standard beverage cans supported on the disk 35 within the tube 33.

Figure 7:
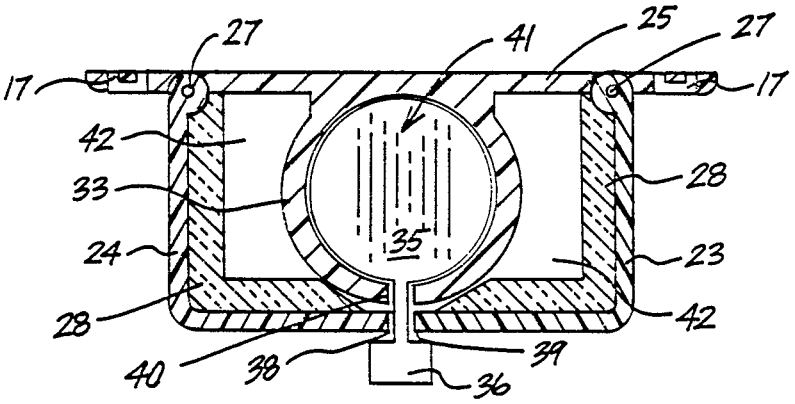
FIG. 7 is a transverse cross sectional view, taken along line 7—7 of FIG. 4.

FIG. 7 provides transverse cross sectional view, taken along line 7—7 of FIG. 4, which illustrates the actuating lever 36 received through the slotted portion 40 of the tube 33 and extending outwardly through the slotted notched out portions 38 and 39 formed on the meeting edges of the doors 23 and 24. By manual movement of the actuating lever 36, the top can in a stack may be moved upwardly and dispensed.

Figure 8:
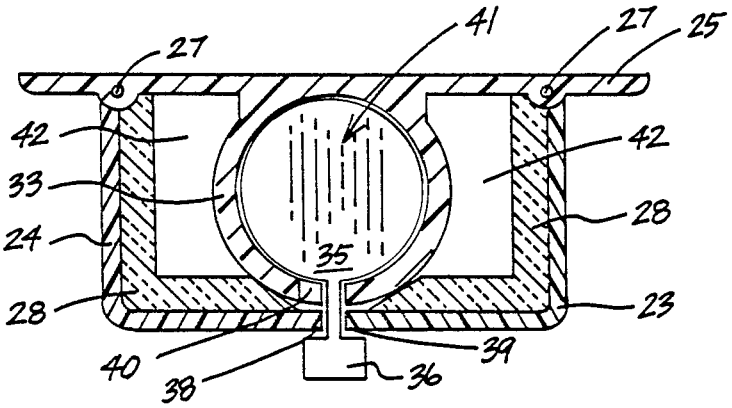
FIG. 8 is a transverse cross sectional view, taken along line 8—8 of FIG. 4.

FIG. 8 depicts a cross sectional view, taken along line 8—8 of FIG. 4.

With reference now to FIGS. 9 through 12, a second embodiment of the present invention will now be described.

Figure 9:
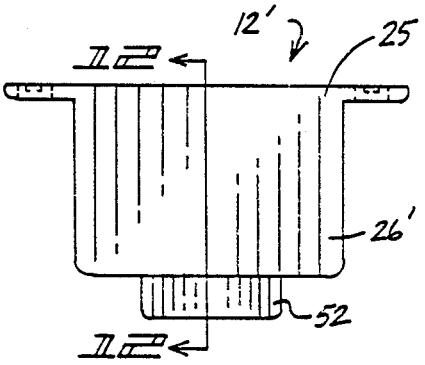
FIG. 9 is a top view of a beverage cooler according to a second embodiment of the present invention.

FIG. 9 provides a top view which illustrates a beverage cooler 12' according to the second embodiment of the present invention. Similar parts of the second embodiment 12' have been referenced utilizing the numbers utilized in connected with the first embodiment 12.

Figure 10:
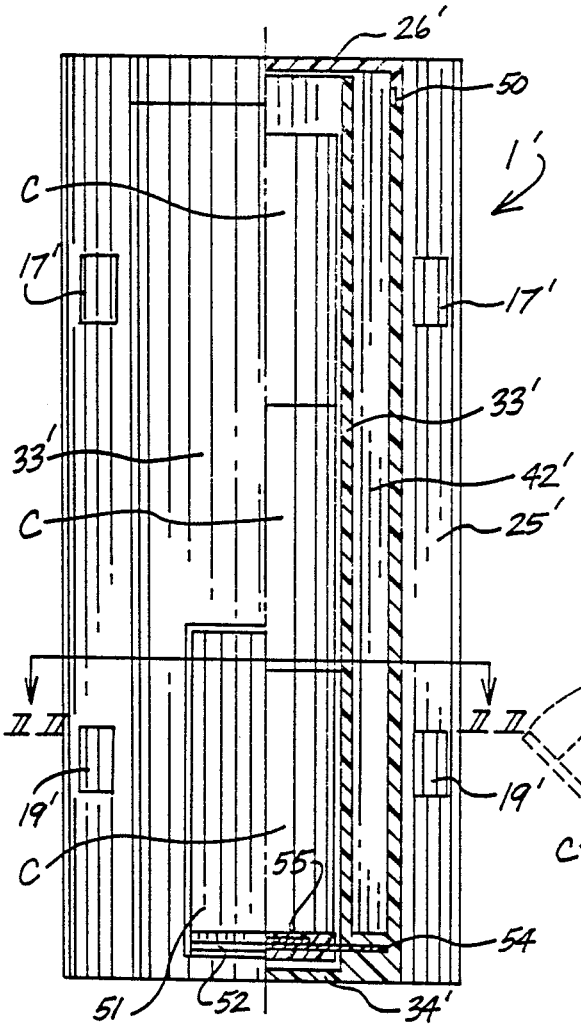
FIG. 10 is a front view, partially in section, illustrating the construction of the beverage cooler according to the second embodiment of the present invention.

FIG. 10 provides a front view, partially in section. As in the first embodiment, a generally rectangular elongated base 25' is provided with pairs of aligned slots 17' and 19' for attachment by straps to a standard golf bag. An elongated, generally rectangular beverage can storage tube 33' extends between top 26' and bottom 34' portions of the base 25'. The top portion 26' is removably connected by a frictional interfitting joint 50 to the tube 33'. The lid 26' is manually removed to allow standard beverage cans C to be inserted within the central portion of the tube 33'. An L-shaped door has a first portion 51 which forms a front side wall portion of the tube 33' and a second portion which forms a bottom interior floor of the tube 33'. The door is pivotally mounted by a pin 54 at an intersection of the side wall and bottom portions. A torsional spring 55 received around the pin 54 biases the side wall portion 51 of the door to the illustrated closed position. The can storage tube 33' has a double wall construction, which forms enclosed insulated chambers 42' on opposite sides of the can stack for the reception of refreezable cooling packages 43 (FIG. 2).

Figure 11:
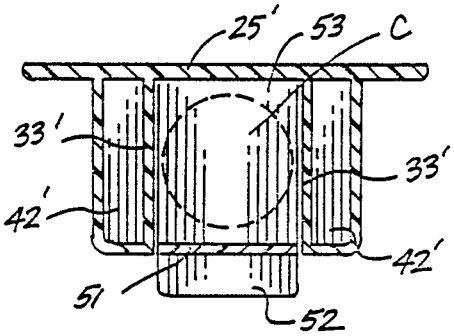
FIG. 11 is a transverse cross sectional view, taken along line 11—11 of FIG. 10.

FIG. 11 depicts a transverse cross sectional view, taken along line 11—11 of FIG. 10, which illustrates the double wall construction of the tube 33' and the L-shaped configuration of the dispensing door. An actuating lever 52 which is an outward extension of the bottom portion 53 of the door is depressed downwardly to pivot the side wall portion 51 of the door outwardly and thus dispense the bottom can C in the stack.

Figure 12:
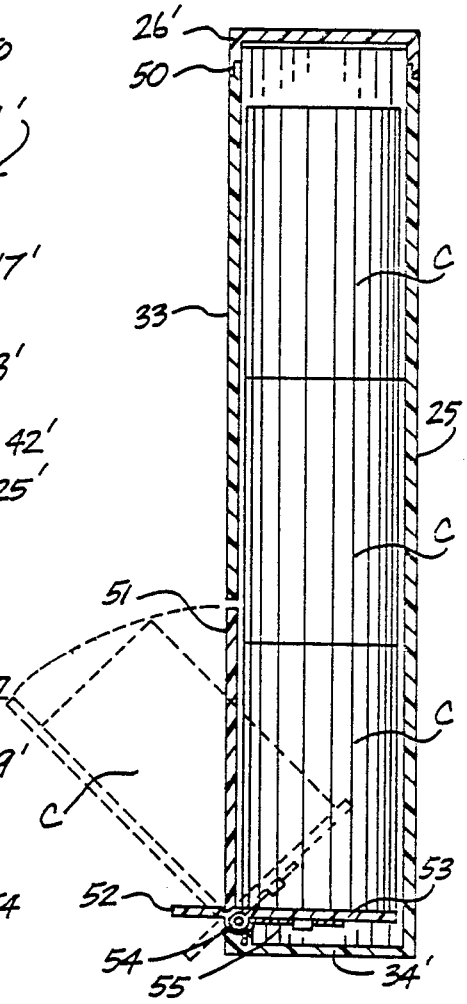
FIG. 12 is a longitudinal cross sectional view, taken along line 12—12 of FIG. 9.

FIG. 12 illustrates a longitudinal cross sectional view, taken along line 12—12 of FIG. 9, which illustrates the dispensing door moved to an open position in phantom line. As may now be understood, upon removal of the bottom can C, the remaining cans in the stack will move downwardly, to be sequentially dispensed as desired. The torsional coil spring 55 is received around the hinge pin 54 and has a first end in contact with the bottom portion 53 and a second end embedded in the base bottom portion 34'.

Figure 13:
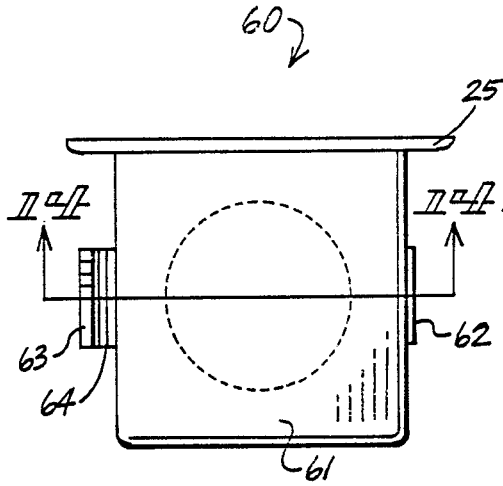
FIG. 13 is a top view of a beverage cooler according to a third embodiment of the invention.

FIG. 13 is a top view illustrating a beverage cooler according to a third embodiment 60 of the invention, in which the cans are dispensed through a top pivotal door 61 which is mounted for pivotal movement about a horizontal axis by a hinge 62. A latch 63 is pivotally mounted on a bracket 64, and retains the door 61 in the illustrated closed position.

Figure 14:
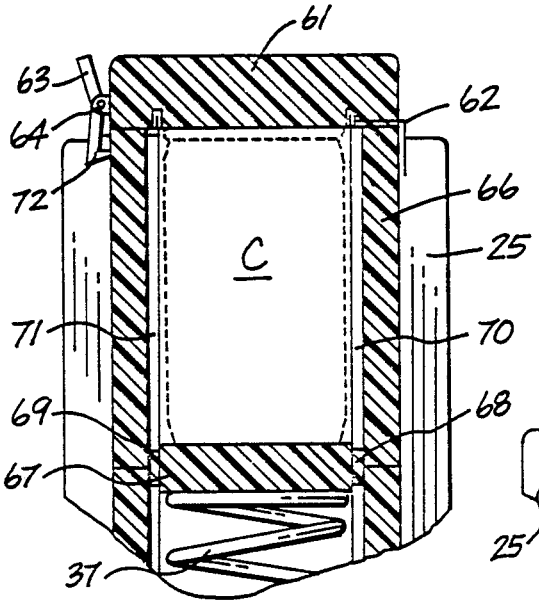
FIG. 14 is a longitudinal cross sectional view, taken along line 14—14 of FIG. 13.

As shown in FIG. 14, an insulated housing 66 has a central longitudinally extending bore having a pair of diametrically opposed notches 70 and 71 which receive guide tabs 68 and 69 formed on a can support disk 67. The housing 66 is secured to a base plate 25 which may be built into a golf bag during manufacture, or retrofitted to an existing golf bag. The housing 66 may be formed by joining a plurality of discrete sections, or as a continuous unit. The can receiving bore has a diameter dimensioned to receive a standard beverage can C, with a surrounding clearance, forming an insulating air space. The disk 67 is supported and biased upwardly by a spring 37, as described with respect to the first embodiment of the invention. The lid securing latch 63 has a lateral catch 72 which engages a complementary formed latch member on the sidewall of the housing 66.

Figure 15:
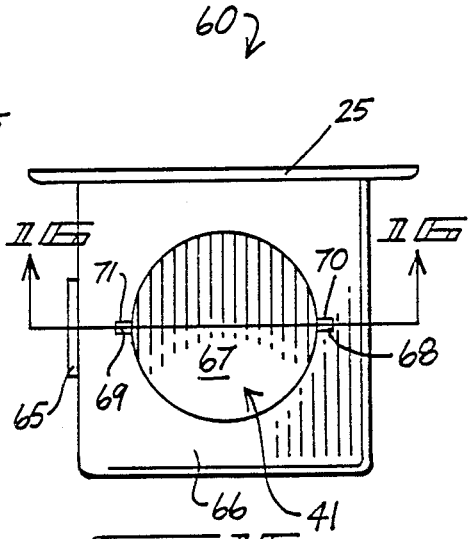
FIG. 15 is a top view of the beverage cooler of FIG. 13, with the can access door removed.

FIG. 15 is a top view of the cooler 60, with the lid 61 removed, illustrating the latch member 65, and the relationship between the guide tabs 68 and 69 and the guide notches 70 and 71.

Figure 16:
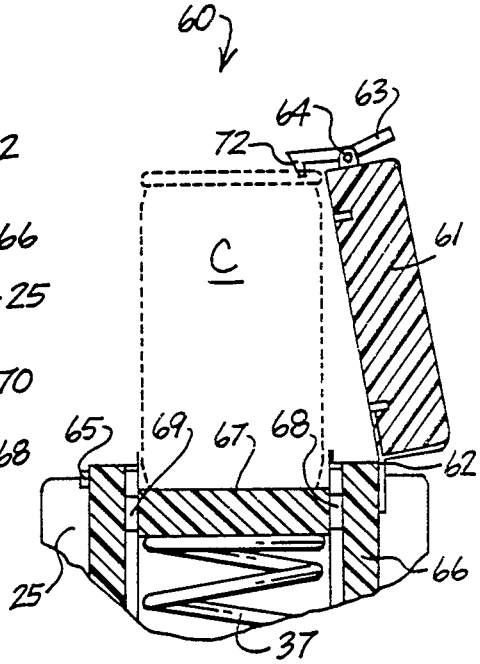
FIG. 16 is a partial cross sectional view, taken along line 16—16 of FIG. 15, illustrating a can being dispensed from the beverage cooler.

FIG. 16 illustrates the lid 61 pivoted to an open position, with the lateral catch member 72 of the latch 63 engaging the rim of the beverage can C. Upon initially releasing the latch 63 from the position of FIG. 14, the can C forces the lid 61 open, until the can C is restrained by the catch 72. At this point, the can C is manually removed and the door 61 is reclosed.

Figure 17:
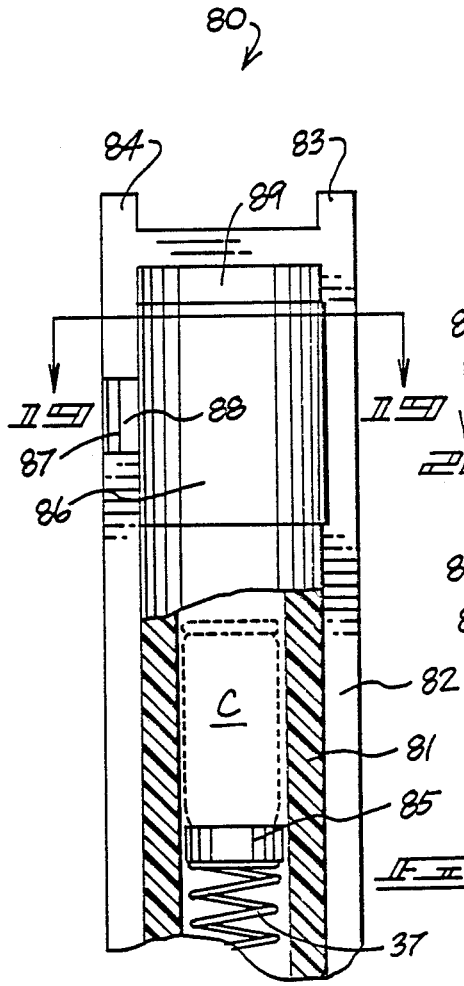
FIG. 17 is a front view, partially in cross section, illustrating a beverage cooler according to a fourth embodiment of the invention.

FIG. 17 is a front view illustrating a cooler 80 according to a fourth embodiment of the invention, in which a base plate 82 has an upper end provided with a pair of hooks 83 and 84 for engagement with a golf bag. This affords a gravitational securement of the cooler 80 to a conventional golf bag. An elongated insulated housing 81 has a hollow interior dimensioned to receive a plurality of stacked standard beverage cans C. A can support disk 85 is slidably received in the housing 81 and is biased upwardly by a spring 37. A door 86 is formed adjacent a fixed top lid 89 of the housing 81, and is mounted for pivotal movement about a vertical axis. Cooperating latch members 87 and 88, on the housing 81 and door 86, respectively, secure the door 86 in a closed position.

Figure 18:
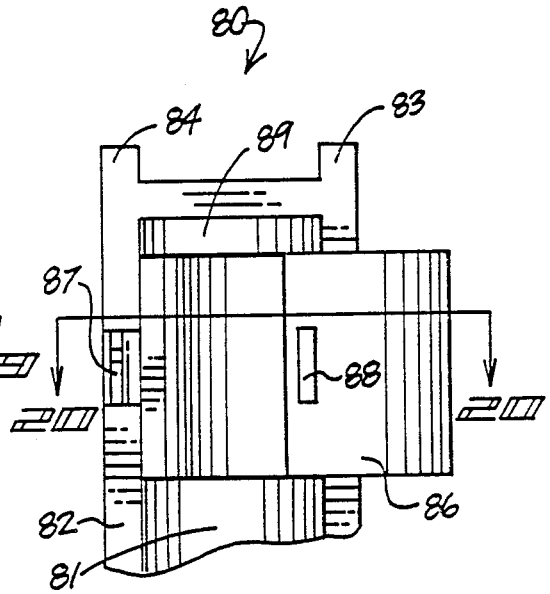
FIG. 18 is a partial front view of the beverage cooler of FIG. 17, illustrating the can access door in an open position.

FIG. 18 illustrated the door 86 pivoted to a partially open position.

Figure 19:
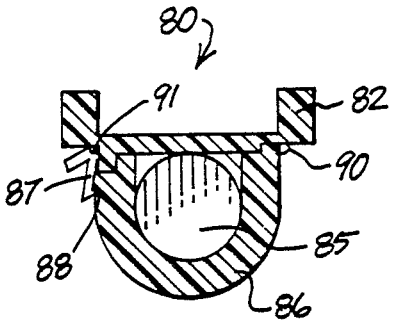
FIG. 19 is a transverse cross sectional view taken along line 19—19 of FIG. 17.

FIG. 19 illustrates the latch 87 mounted by a pivot pin 91 and in engagement with the latch 88 on the door 86. A hinge 90 mounts the door 86 for pivotal movement.

Figure 20:
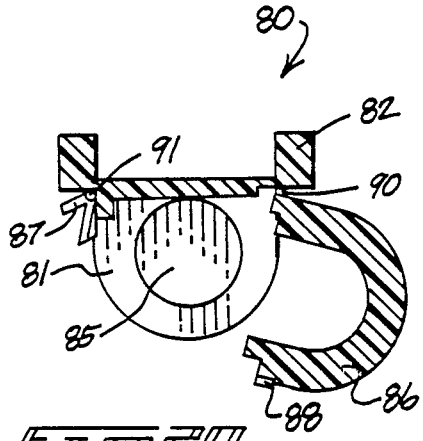
FIG. 20 is a transverse cross sectional view taken along line 20—20 of FIG. 18.

FIG. 20 illustrates the door 86 in an open position. For an additional cooling effect, refreezable cooling packages of the same diameter as a standard beverage can, but having a shorter length, may be inserted into the interior 81, along with the beverage cans.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf bag beverage cooler for attachment to a golf bag, comprising:

elongated base means;

strap means for securing said base means on a golf bag;

said base means having spaced parallel top and bottom portions;

can storage tube means extending between said top and bottom portions;

enclosed insulated chamber means formed adjacent said tube means;

a circular access opening formed in said base top portion in alignment with an upper end of said tube means for dispensing beverage cans from said tube means;

cooling package means filled with a freezable fluid material received in said insulated chamber means;

a longitudinal slot formed in said tube means; and a cylindrical beverage can support disk received for longitudinal sliding movement in said tube means.

2. The golf bag beverage cooler of claim 1, further comprising an actuating lever connected to said disk and extending outwardly through said slot for manually sliding said disk.

3. The golf bag beverage cooler of claim 2, further comprising a coil spring in said tube means;

said spring having a first end in abutment with said disk and a second end in abutment with said base means bottom portion; and said spring having a predetermined spring constant selected for maintaining a stack of standard beverage cans supported on said disk at a constant level as cans are removed.

4. A golf bag beverage cooler for attachment to a golf bag, comprising:

elongated base means;

strap means for securing said base means on a golf bag;

said base means having spaced parallel top and bottom portions;

can storage tube means extending between said top and bottom portions;

enclosed insulated chamber means formed adjacent said tube means;

access opening means formed adjacent one of said top and bottom portions for dispensing beverage cans from said tube means;

cooling package means filled with a freezable fluid material received in said insulated chamber means;

a pair of L-shaped doors mounted on said base means on opposite side of said tube means by hinges for pivotal movement about axes parallel to a longitudinal axis of said tube means; and cooperating latches on meeting edges of said doors for securing said doors in a closed position around said tube means.

5. The golf bag beverage cooler of claim 4, wherein said doors are each provided with insulation and form a pair of parallel insulated chambers on opposite sides of said tube means; and said meeting edges of said doors having cooperating notched out portions forming a longitudinal slot.

6. A golf bag beverage cooler for attachment to a golf bag, comprising:

elongated base means;

strap means for securing said base means on a golf bag;

said base means having spaced parallel top and bottom portions;

can storage tube means extending between said top and bottom portions;

enclosed insulated chamber means formed adjacent said tube means;

cooling package means filled with a freezable fluid material received in said insulated chamber means;

access opening means formed adjacent said bottom portion of said base means for dispensing beverage cans from said tube means;

said access opening means including an L-shaped pivotal door forming bottom and side wall portions of said tube means;

said door mounted by a pin adjacent an intersection of said bottom and side wall door portions for movement about an axis extending perpendicular to a longitudinal axis of said tube means;

spring means urging said door to a closed position; and outwardly extending lever means on said door for manually opening said door and dispensing a bottom can from a stack of cans in said tube means.

* * * * *